United States Patent [19]

Zevchak

[11] Patent Number: 5,054,127

[45] Date of Patent: Oct. 8, 1991

[54] DETACHABLE POCKET SYSTEM FOR GARMENTS AND THE LIKE

[76] Inventor: Eric Scott Zevchak, 155 Redruth, Clawson, Mich. 48017

[21] Appl. No.: 539,188

[22] Filed: Jun. 18, 1990

[51] Int. Cl.[5] ..... A41D 27/20

[52] U.S. Cl. ..... 2/247; 2/69; 2/79; 2/227; 2/250

[58] Field of Search ..... 2/2, 69, 69.5, 79, 94, 2/115, 227, 244, 247, 248, 249, 250, 251, 252

[56] References Cited

U.S. PATENT DOCUMENTS

| | | | |
|---|---|---|---|
| D. 281,636 | 12/1985 | Cressy-Renoma . | |
| 779,898 | 1/1905 | Yates . | |
| 1,596,533 | 8/1926 | Haubenstock . | |
| 1,655,895 | 1/1928 | Davis . | |
| 1,764,483 | 6/1930 | Watkins . | |
| 2,066,072 | 12/1936 | Powell | 2/94 X |
| 2,389,697 | 11/1945 | Stoeckert . | |
| 2,448,416 | 8/1948 | Carter . | |
| 2,591,059 | 4/1952 | Frohman . | |
| 2,604,627 | 7/1952 | Abbott . | |
| 3,137,865 | 6/1964 | Evans et al. . | |
| 3,438,062 | 4/1969 | Dobell . | |
| 3,537,108 | 11/1970 | Daniels | 2/252 |
| 3,611,444 | 10/1971 | Rector . | |
| 3,624,686 | 11/1971 | Beals . | |
| 3,840,901 | 10/1974 | Eyster . | |
| 4,006,495 | 2/1977 | Jones . | |
| 4,218,781 | 8/1980 | Lieberman | 2/247 |
| 4,266,300 | 5/1981 | Partridge . | |
| 4,308,622 | 1/1982 | Maddron | 2/79 |
| 4,384,369 | 5/1983 | Prince | 2/79 |
| 4,507,882 | 4/1985 | Harrell | 2/247 X |
| 4,513,454 | 4/1985 | Anderson et al. . | |
| 4,555,812 | 12/1985 | Akers | 2/94 |
| 4,602,390 | 7/1986 | Morera et al. . | |
| 4,608,716 | 9/1986 | Brumfield | 2/79 X |
| 4,651,355 | 3/1987 | White . | |
| 4,669,125 | 6/1987 | Allen | 2/2 |
| 4,899,395 | 2/1990 | Spector | 2/249 X |

FOREIGN PATENT DOCUMENTS

| | | | |
|---|---|---|---|
| 1124363 | 2/1962 | Fed. Rep. of Germany | 2/2 |
| 1067406 | 6/1954 | France | 2/79 |
| 2136675 | 9/1984 | United Kingdom | 2/2 |

*Primary Examiner*—Werner H. Schroeder
*Assistant Examiner*—Jeanette E. Chapman
*Attorney, Agent, or Firm*—Harness, Dickey & Pierce

[57] ABSTRACT

A system of interchangeable pockets. The system generally comprises a plurality of base pads attached to articles of clothing and a plurality of interchangeable pockets. The pockets of the system are made interchangeable by attaching a first type of fastening material to the back of each pocket and a corresponding second type of fastening material to each base pad.

17 Claims, 1 Drawing Sheet

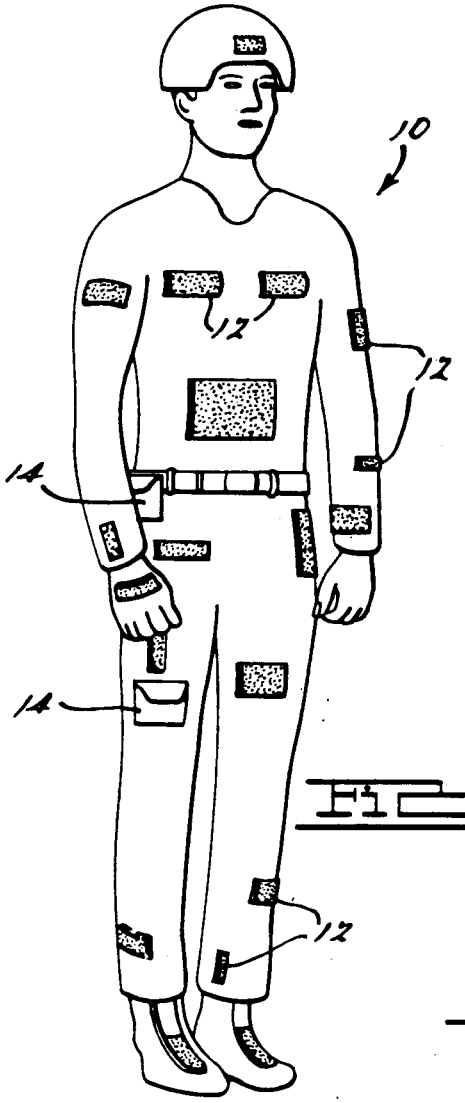
FIG. 1.
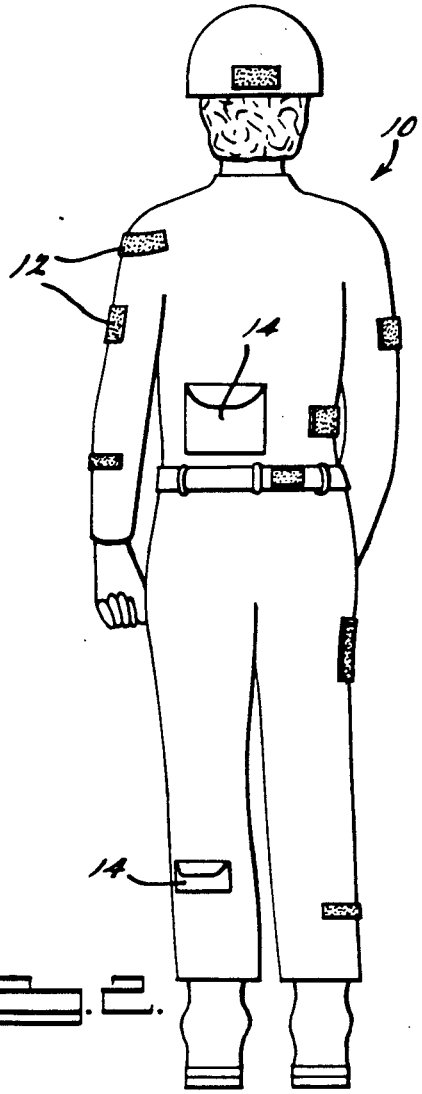
FIG. 2.
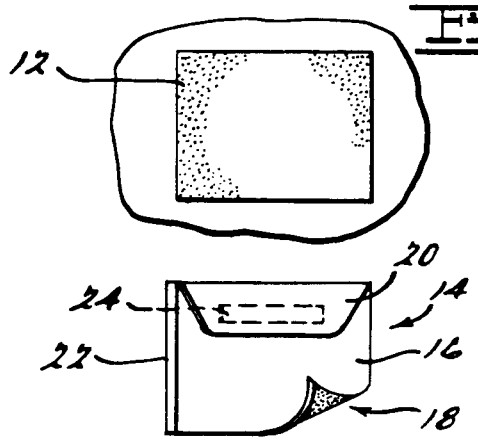
FIG. 3.
FIG. 4.
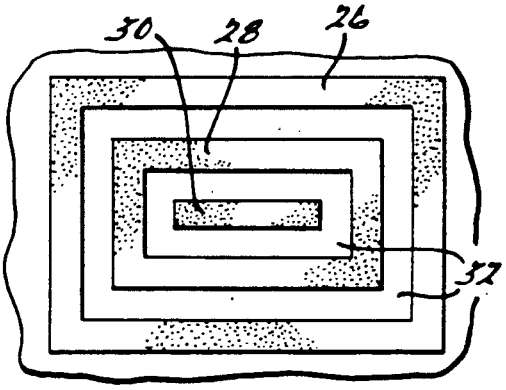
FIG. 5.

DETACHABLE POCKET SYSTEM FOR GARMENTS AND THE LIKE

BACKGROUND OF THE INVENTION

1. Technical Field

This invention relates to a system of pockets and, more particularly, to an interchangeable system of pockets in which the pockets can be releasably attached randomly about articles of clothing.

2. Discussion

Often it is desired to place small items, which are to be transported manually, in pockets. This allows the hands of the transporter to be unburdened. Additionally, the maximum load transportable by the wearer of the pocketed garment can be increased. Typically, pockets are permanently secured to articles of clothing, thus restricting the user to a predetermined pocket arrangement and a predetermined pocket capacity.

The prior art is replete with myriad pocket constructions capable of removably attaching to articles of clothing as evidenced by U.S. Pat. Nos. 3,438,062, 3,611,444, 3,624,686 and 4,651,355.

None of these devices is without its problems. Some of the devices do not provide for a pocket capable of incorporation into a system of interchangeable pockets. Additionally, some of the devices do not provide a readily attachable pocket. Further, some of the devices do not provide a pocket capable of safely retaining the pocket's contents.

SUMMARY OF THE INVENTION

The benefits and advantages of the present invention are achieved through a system of interchangeable pockets. Each pocket of the system is made from two rectangular sides. The sides are permanently non-releasably joined on two side edges and a bottom edge with the top edge providing access into the pocket. A first type of fastening material is attached to the back of each pocket. This first type of fastening material is either the hooked or looped material, both of which are commonly sold together under the trademark "Velcro". The system of this invention further provides a plurality of base pads that can be non-releasably attached to articles of clothing. Each of the base pads is constructed of a second type of fastening material, which is the opposite fastening material attached to the back of each pocket. The first and second type of fastening materials are capable of releasable attachment to one another.

The present invention has the object of providing the user with a system of pockets capable of meeting the user's individual and changing pocket capacity requirements. Another object is to provide such a system in which the user controls the final location of the pockets. Other objects, features and advantages of the present invention will become readily apparent after reading the following description in light of the accompanying drawings.

BRIEF DESCRIPTION OF THE DRAWINGS

FIG. 1 is a perspective view of a system of interchangeable pockets made in accordance with the preferred embodiment of this invention shown in a functional relationship with the system's user;

FIG. 2 is a rear view of the system shown in a functional relationship with the system's user;

FIG. 3 is a front view of a pocket made in accordance with the preferred embodiment of this invention;

FIG. 4 is a front view of a base pad made in accordance with the preferred embodiment of this invention;

FIG. 5 is a front view of an alternative embodiment of the base pad.

DETAILED DESCRIPTION AND PREFERRED EMBODIMENTS

Referring to FIGS. 1 and 2, a representation of a system of interchangeable pockets 10 according to the present invention is shown in a functional relationship with the system's user. The system of interchangeable pockets 10 generally comprises a plurality of base pads 12 non-releasably attached to various locations on articles of clothing and a plurality of interchangeable pockets 14 capable of releasably attaching to the base pads.

Turning to FIG. 3, an interchangeable pocket 14 made in accordance with the present invention is shown. In the preferred embodiment the pocket 14 is constructed from a first side 16, a second side 18 and an intermediate side 22. The first and second sides 16 and 18 of the pocket 14 are disposed generally parallel to one another and are connected along a substantial portion of their peripheries to the intermediate side 22 which is disposed substantially perpendicular to the first and second sides 16 and 18. The portion of the peripheries left unjoined to the intermediate side 22 thereby provides access into the pocket. In one embodiment, the first side 16 and the second side 18 are peripherally joined to the intermediate side 22 along the bottom edges and two side edges, with the top edges left unjoined for access into the pocket 14. In another embodiment, the first and second sides 16 and 18 are formed from a continuous length of material. In this embodiment, the two side edges are joined to an intermediate side 22 with the top edges left unjoined for access into the pocket 14. By providing an intermediate side 22 to the pocket 14 the depth and therefore the capacity of the pocket 14 is increased.

The first parallel side 16, which forms the front of the pocket 14, is substantially longer in length from top to bottom than the corresponding second parallel side 18, which forms the back of the pocket 14. This extra length of the pocket's back side is folded down to meet the front side of the pocket 16, thus forming a flap 20 for the pocket 14. This flap 20 will assist in retaining items that are placed into the pocket 14.

In another embodiment, the first and second sides 16 and 18 of the pocket 14 are non-releasably joined directly to one another by strong stitching along a substantial portion of their peripheries. While due to capacity restrictions this embodiment is not preferred, it offers a less expensive and easier to manufacture alternative.

FIG. 4 shows a base pad 12. The shape of the base pad 12 is immaterial as long as it can support a pocket 14, with its load, when the base pad 12 and the pocket 14 are engaged. A pocket 14, such as the one depicted in FIG. 3 is adapted to releasably attach to the base pad 12 of FIG. 4. This releasable attachment is accomplished by utilizing first and second fastening materials like those which are commercially sold under the trademark "VELCRO". The base pad 12 is constructed of a first kind of this fastening material, either the hooked fabric or the looped fabric. Accordingly, the corresponding fastening material is non-releasably attached to the back of the pocket 14 of the interchangeable pocket system 10. While the base pads 12 may be constructed of either the hooked fabric or the looped fabric, all the base pads 12 of the entire system 10 should be constructed of the same kind of fastening material. This consistency maximizes the interchangeability of each pocket 14 within the system 10.

Continuing with the description of FIG. 3, a thin strip of a first type of fastening material 24 (shown in hidden lines) is non-releasably attached horizontally along the underside of the flap 20. The width of the strip 24 is preferably between one-fourth and three-eighths inch wide. However, special load capacities may require different dimensions. The length of the horizontal strip 24 should be sufficient to substantially traverse the entire flap 20. A corresponding strip (not shown) of equal or slightly greater dimensions of a second type of fastening material is non-releasably attached to the second side 16 of the pocket 14 adjacent the horizontal strip of first type of fastening material 24. These corresponding horizontal strips of fastening material can be releasably attached in order to secure the contents of the pocket 14. The means of releasably attaching the flap 20 to the pocket 14 is immaterial. Alternatively, zippers, buttons and snaps could be incorporated.

FIG. 5 is an alternative embodiment of the base pad 12 of the subject system of interchangeable pockets 10. In this embodiment, the fastening material of the base pad is in multiple sections 26, 28 and 30 which are separated from one another by areas of a fabric 32 capable of permitting ventilation. In one embodiment the largest piece of fastening material 26 forms the outer border of the base pad and is between one-fourth inch and three-fourths inch in width. A second border of fastening material 28, also between one-fourth inch and three-fourth inch in width, is situated within the outer border 26. The third section of fastening material 30 is rectangular and is disposed within the first two pieces 26 and 28. However, the number and shape of the base pad elements is immaterial so long as there are areas of ventilation. Further ventilation can be provided by aligning small ventilation holes in the base pad 12 and the pocket 14.

The interchangeable pocket system 10 of the present invention is intended to incorporate full usage of the carrying capabilities of the human body. Through use of the present invention, an interchangeable pocket 14 of the present system 10 can be worn on virtually every area of the body capable of being clothed. It is recommended that the individual pockets be considered for incorporation on areas such as boots, lower and upper leg areas, sides of hips, lower abdomen, upper chest area, lower and upper arms, the rear of the hand between the knuckles and wrist, lower and upper back, on a hat or helmet, and on a belt. While the pockets 14 can be placed on additional areas, they are not suggested for use on friction joint areas such as the ankles, heels of the feet, behind the knees, rear buttocks area, wrists, elbow joints, or areas around the neck.

In use, the interchangeable pocket system 10 can be used to evenly distribute weight load. It can also be used to concentrate weight load on stronger areas and correspondingly lessen weight load on weaker, fatigued or injured areas. The system 10 can accommodate persons of all physical strengths and shapes, and either gender. This flexibility of the pocket system 10 is increasingly facilitated through the broad range of possible pocket sizes. A particular interchangeable pocket 14 can be designed to be any size necessary to accommodate a particular physical attribute or a specific need.

The pockets 14 of the interchangeable pocket system 10 can also be adapted to a particular environment. For example the material of the first and second parallel sides 16 and 18 can be made of waterproof or water resistant material.

The system 10 as shown in FIGS. 1 and 2, can be utilized in countless situations, the most obvious of which is the military. The clothing to which the pockets 14 of the system 10 are attached could include all articles of standard issue military fatigues. The system 10 would allow the average combat trooper to stay on duty in the field from several hours to several days longer. The trooper would have extra equipment to sustain his or her existence in the field. Fire power could be increased by up to 75%. Sniper, reconnaissance and special assignment teams could penetrate deeper into enemy held territory. Troops with interchangeable pockets 14 will be more comfortable, versatile and flexible. If friendly troops are encountered without working equipment, rations or weapons, they can be partially re-equipped in the field through the extra equipment, rations and weapons carried in the interchangeable pockets 14.

Another obvious application of the pocket system 10 is during hiking. The traditional backpack can be replaced by the present system thereby providing the user with unrestricted hands. The user would also be able to access articles within the pockets 14 without being required to remove the carrying device, such as a backpack requires.

While the above description constitutes the preferred embodiments of the invention, it will be appreciated that the invention is susceptible to modification, variation and change without departing from the proper scope or fair meaning of the accompanying claims.

What is claimed is:

1. A system of interchangeable pockets, said system comprising:

an article of clothing;

a plurality of interchangeable pockets having varying sizes, each said pocket having first and second substantially parallel sides;

a first type of fastening material non-releasably attached to said first side of each said pocket for enabling interchangeable random positioning of said pocket;

a plurality of base pads non-releasably attached at various positions about the area of said article of clothing, each said base pad constructed of a second type of fastening material capable of releasably attaching to said first type of fastening material such that said pocket may be randomly and interchangeably positioned about any one of said second type of fastening material pads.

2. The system of claim 1 wherein said first and second parallel sides are non-releasably joined along a substantial portion of the peripheries of said first and second parallel sides whereby an unjoined portion provides access into said pocket.

3. The system of claim 1 wherein said first and second parallel sides are connected by an intermediate side.

4. The system of cl-aim 1 wherein said second type of fastening material is in a plurality of sections and said sections are separated by areas of ventilating material.

5. The system of claim 1 wherein each said pocket also comprises a flap.

6. The system of claim 5 wherein each said pocket further has means for releasably attaching said flap to said second parallel side.

7. The system of claim 6 wherein said means for releasably attaching said flap to said second side comprises said first type of fastening material attached to said flap and said second type of fastening material attached to said first side.

8. The system of claim 1 where said articles of clothing are military fatigues.

9. The system of claim 1 where said first and second parallel sides are formed from a continuous length of material.

10. A method of load distribution of small items to be manually transported, said method comprising:

providing an article of clothing;

providing a plurality of interchangeable pockets having varying sizes, each said pocket having first and second substantially parallel sides;

providing a first type of fastening material non-releasably attached to said first side of each side pocket for enabling interchangeable random positioning of said pocket;

providing a plurality of substantially rectangular base pads, each said base pad constructed of a second type of fastening material capable of releasably attaching to said first type of fastening material;

non-releasably attaching said base pads to said article of clothing at various positions about the area of the clothing;

releasably attaching said first type of fastening material to said second type of fastening material such that said pocket may be randomly and interchangeably positioned about any one of said second type of fastening material pads; and placing said small items into said pockets.

11. The method of claim 10 wherein said first and second parallel sides are non-releasably joined along a substantial portion of the peripheries of said first and second parallel sides whereby an unjoined portion provides access into said pocket.

12. The method of claim 10 wherein said first and second parallel sides are connected by an intermediate side.

13. The method of claim 10 wherein said second type of fastening material is in a plurality of sections and said sections are separated by areas of ventilating material.

14. The method of claim 10 wherein each said pocket also comprises a flap.

15. The method of claim 14 which further comprises:

providing means for releasably attaching said flap to said second side.

16. The method of claim 15 wherein said means for releasably attaching said flap to said second side comprises said first type of fastening material attached to said flap and said second type of fastening material attached to said first side.

17. The method of claim 10 where said first and second parallel sides are formed from a continuous length of material.

* * * * *